US006086242A

United States Patent [19]

Rajamani et al.

[11] Patent Number: 6,086,242

[45] Date of Patent: Jul. 11, 2000

[54] DUAL DRIVE PLANETARY MILL

[75] Inventors: Raj K. Rajamani; Ludovic Milin, both of Salt Lake City; Glade Howell, Sandy, all of Utah

[73] Assignee: University of Utah, Salt Lake City, Utah

[21] Appl. No.: 09/059,140

[22] Filed: Apr. 13, 1998

Related U.S. Application Data

[60] Provisional application No. 60/076,246, Feb. 27, 1998.

[51] Int. Cl.[7] ..... B01F 9/22; B02C 4/00; B02C 17/08

[52] U.S. Cl. ..... 366/217; 241/21; 241/27; 241/171; 241/175; 241/176; 494/33

[58] Field of Search ..... 241/21, 27, 170, 241/171, 175, 176; 366/217, 219, 220, 235; 494/33

[56] References Cited

U.S. PATENT DOCUMENTS

| | | | |
|---|---|---|---|
| 458,662 | 8/1891 | Pendleton | 241/175 |
| 2,810,156 | 10/1957 | Long . | |
| 2,874,911 | 2/1959 | Limb . | |
| 2,937,814 | 5/1960 | Joisel . | |
| 3,138,979 | 6/1964 | Sendzimir | 80/38 |
| 3,253,446 | 5/1966 | Sendzimir | 72/234 |
| 3,387,357 | 6/1968 | Sendzimir | 29/494 |
| 3,422,656 | 1/1969 | Orr et al. | 72/366 |
| 3,529,780 | 9/1970 | Wilkinson | 241/175 |
| 3,595,054 | 7/1971 | Sendzimir | 72/190 |
| 3,688,541 | 9/1972 | Ohkubo et al. | 72/250 |
| 3,768,139 | 10/1973 | Whalen et al. | 29/403 |
| 3,789,646 | 2/1974 | Sendzimir | 72/190 |
| 3,843,422 | 10/1974 | Henke | 148/111 |
| 3,876,160 | 4/1975 | Bloch | 241/175 |
| 3,921,429 | 11/1975 | Sendzimir | 72/189 |
| 3,969,162 | 7/1976 | Henke | 148/111 |
| 4,022,041 | 5/1977 | Lauener | 72/15 |
| 4,231,818 | 11/1980 | Henke | 148/111 |
| 4,856,313 | 8/1989 | Miura et al. | 72/234 |
| 4,885,041 | 12/1989 | den Hartog et al. | 148/2 |
| 4,901,785 | 2/1990 | Dykes et al. | 164/481 |
| 5,009,396 | 4/1991 | den Hartog et al. | 266/115 |
| 5,029,760 | 7/1991 | Gamblin | 241/65 |
| 5,133,205 | 7/1992 | Rostik et al. | 72/200 |
| 5,147,449 | 9/1992 | Grewe et al. | 75/354 |
| 5,187,956 | 2/1993 | Figge et al. | 72/190 |
| 5,205,499 | 4/1993 | Gamblin | 241/137 |
| 5,274,965 | 1/1994 | Figge et al. | 51/49 |
| 5,354,560 | 10/1994 | Lovrecich | 424/489 |
| 5,364,036 | 11/1994 | Falcon-Steward | 241/21 |
| 5,366,166 | 11/1994 | Schliz et al. | 241/30 |
| 5,375,783 | 12/1994 | Gamblin | 241/175 |
| 5,478,705 | 12/1995 | Czekai et al. | 430/449 |
| 5,500,331 | 3/1996 | Czekai et al. | 430/449 |
| 5,513,806 | 5/1996 | Falcon-Steward | 241/21 |
| 5,518,187 | 5/1996 | Bruno et al. | 241/5 |

OTHER PUBLICATIONS

Advertisement, "The Cyclomill, A Completely New Type of Grinding Machine," Burch Manufacturing Corporation, 11312 Tamarco Drive, Cincinnati, OH 45242, 1997.

Ludovic Milin and Rej. K. Rajamani, "Kinetics of Alumina Ultrafine Grinding in a Planetary Ball Mill," *Materials and Manufacturing Process,* vol. 12, No. 2, 241–260, 1997.

Peihong Ding, thesis entitled: "Ultrafine Grinding of Silicon Carbide in a Batch Planetary Mill.", Mar. 1996.

*Primary Examiner*—Joseph W. Drodge

*Attorney, Agent, or Firm*—Kirton & McConkie; Dale E. Hulse; Berne S. Broadbent

[57] ABSTRACT

A mill for grinding and/or mixing a material. In one presently preferred embodiment of the present invention, the mill includes a first container rotatably mounted at a first end of a gyration arm. The container rotates about a first axis, and the gyration arm rotates about a second axis. The mill may further include a second container mounted at a second end of the gyration arm. The second container is rotatable about a third axis. As the gyration arm rotates about the second axis, the containers move with the gyration arm. In addition, the containers themselves rotate about their own respective axes thereby greatly enhancing the forces within the containers effecting the grinding and/or mixing. A first motor may be used to rotate the gyration arm, and a second motor may be used to rotate the containers about their respective axes. The mill may be operated in a continuous mode or in a batch mode.

40 Claims, 12 Drawing Sheets

DUAL DRIVE PLANETARY MILL

1. RELATED APPLICATIONS

This application claims the benefit of provisional application application Ser. No. 60/076,246, filed on Feb. 27, 1998 for "DUAL DRIVE PLANETARY MILL," the content of which is incorporated herein by reference and the priority of which is claimed under 35 U.S.C. § 119(e).

2. THE FIELD OF THE INVENTION

This invention relates to grinding and/or mixing materials and, more particularly, to novel systems and methods for grinding and/or mixing materials within a mill.

BACKGROUND

There are many industrial fields today that require powders. Some types of concrete require finely ground limestone, clay, and/or sand. The food industry requires many items to be ground including wheat, corn, rice, and the like. Some paint products also require ground pigments to provide color. Ceramics are made from ground materials. Metallic pigments require metals to be ground. There are many other industrial products and processes that require ground materials. As shown, many different industries require materials to be ground into a finer state. The different industrial and product requirements call for different degrees of fineness, depending upon the particular purpose of the powder.

One way in which materials are ground and/or mixed is through the use of ball mills. Ball mills typically include a chamber where the grinding and/or mixing takes place. Usually, the material to be ground or the materials to be mixed are placed in the chamber along with many steel or ceramic balls. The mill is then rotated, spun, or otherwise agitated to create a tumbling action within the chamber between the material and the balls. The balls hit one other and, as a result, grind and mix material that is found in between the balls. Also, the shearing action between the material and the balls further serves to grind the material. In addition, the shearing action between the material and the container walls effectively grinds the material into a finer material. After a time, the material within the ball mill is thus ground into a finer state and/or is better mixed.

As suggested earlier, the fineness of the powder varies according to the particular need. The finer the powder required, the smaller the particles need to be ground to produce the powder. The production of submicron-size powder is receiving greater attention because of the increasing demand for structural ceramics, magnetic materials, electronic packaging materials, and metal-ceramic composites. At the present time, such fine powders may be generated using, for example, ball mills, stirred ball mills, and vibration mills. However, these types of mills exhibit limitations when used to produce powders which are very fine. In this regard, such mills are typically only capable of producing a powder having a minimum particle size of about one micron (1 $\mu$m) after several hours of grinding.

One reason for this minimum particle size limitation is the fact that particles are weakly confined in the breakage zone of these mills. The breakage zone is generally the interstices of the ball mass within the mill. Simply stated, the particles reside in the interstices between the balls, and are confined only by the weight of the ball mass. Accordingly, the particles may easily escape from this zone and avoid being ground to the degree they would be if they were within the breakage zone.

BRIEF SUMMARY

In one presently preferred embodiment, the present invention relates to a mill for grinding and/or mixing material including a first container rotatably mounted at a first end of a gyration arm. The container rotates about a first axis, and the gyration arm rotates about a second axis which is preferably different from the first axis. The mill of the present invention preferably further includes a second container mounted at a second end of the gyration arm. The second container is rotatable about a third axis which is preferably different from the first and second axes. As the gyration arm rotates about the second axis, the containers move with the gyration arm in what might be termed a "planetary" motion. In addition, the containers themselves rotate about their own respective axes. The combination of motions of the rotating gyration arm (or planetary motion) and the rotation of the individual containers greatly enhances the forces within the containers effecting the grinding. A first motor is preferably used to rotate the gyration arm, while a second motor is preferably used to rotate the containers about their respective axes. Thus, the present invention in one presently preferred embodiment might be referred to as a "dual drive planetary mill." The two distinct motions, the gyration arm rotation or planetary motion and the individual container rotations, may be facilitated through a split shaft positioned along the second axis.

The mill may be operated in a continuous mode or in a batch mode. When operating in a continuous mode, the containers preferably include means for feeding the material to be ground into the containers. For example, the means for feeding may comprise inlets formed in the containers. When operating in continuous mode, the mill preferably also includes a supply of the material in fluid communication with the means for feeding. Rotary joints are preferably used in the present invention to facilitate fluid communication between the supply and the means for feeding. The mill operating in the continuous mode also preferably includes means for expelling ground material from the containers. In one preferred embodiment, the means for expelling may comprise outlets formed in the containers. Means for receiving the ground material is preferably positioned to collect the ground material as it exits through the means for expelling. In one preferred embodiment, the means for receiving may be a collection ring capable of continuously receiving the ground material.

From the above, it will be appreciated that the present invention provides a novel mill for grinding and mixing materials therein. With the combination of motions produced by the present invention, a very high centrifugal field is generated, confining the particles firmly in the breakage zone, namely, in the interstices between the balls when a ball-type mill is employed in accordance with the principles of the present invention. This greatly enhances the fineness of powder and/or mixing that may be achieved by the mill. The limitations on product fineness typically encountered in the prior art are thus significantly overcome through the present invention. In addition, because of the high centrifugal field created, more material may be processed with the present invention in the same or a shorter period of time than with typical prior art mills. In addition, because of the high-intensity impact forces within the mill, mechanochemical activation of the material is increased.

BRIEF DESCRIPTION OF THE DRAWINGS

The foregoing brief summary and other features of the present invention will become more fully apparent from the following description and appended claims, taken in conjunction with the accompanying drawings. These drawings depict only exemplary embodiments of the present invention and are, therefore, not to be considered limiting of its scope. Presently preferred embodiments of the present invention will thus now be described with additional specificity and detail through use of the accompanying drawings in which:

DETAILED DESCRIPTION OF THE PREFERRED EMBODIMENTS

Figure 1:
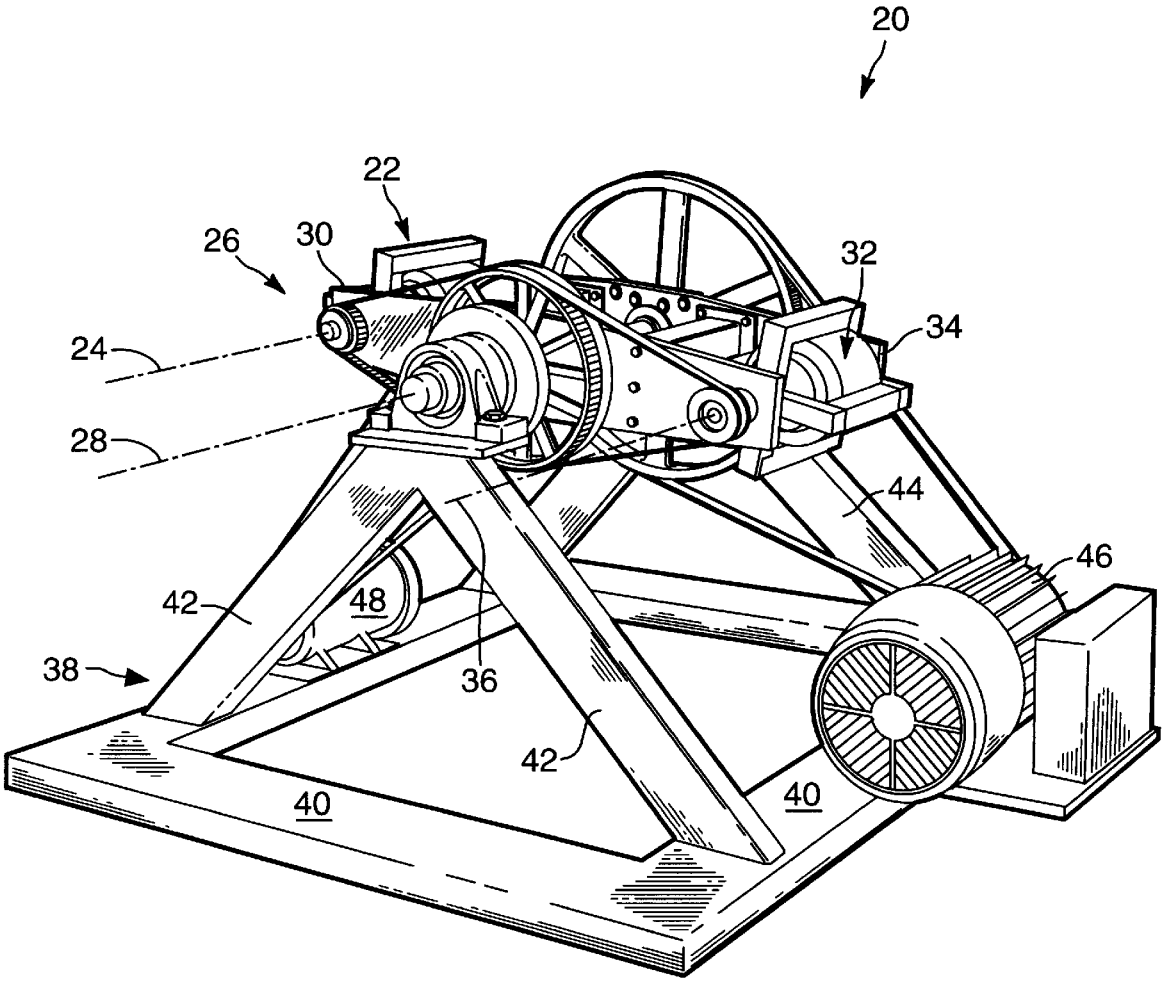
FIG. 1 is a perspective view of one presently preferred embodiment of a dual drive planetary mill within the scope of the present invention operating in a batch mode.

It will be readily understood that the various components of the present invention, as generally described and illustrated in the Figures herein, could be arranged and designed in a wide variety of different configurations. Thus, the following more detailed description of the embodiments of the systems and methods of the present invention, as represented in FIGS. 1 through 12, is not intended to limit the scope of the invention, but it is merely illustrative of and representative of exemplary and presently preferred embodiments of the invention.

The presently preferred embodiments of the invention will be better understood by reference to the drawings, wherein like parts are designated by like numerals throughout.

In one presently preferred embodiment, a mill 20 for grinding and/or mixing material includes a first container 22 rotatable about a first axis 24 mounted on a gyration arm 26. The gyration arm 26 rotates about a second axis 28, which is different from the first axis 24. The first container 22 is rotatably mounted at a first end 30 of the gyration arm 26.

Figure 2:
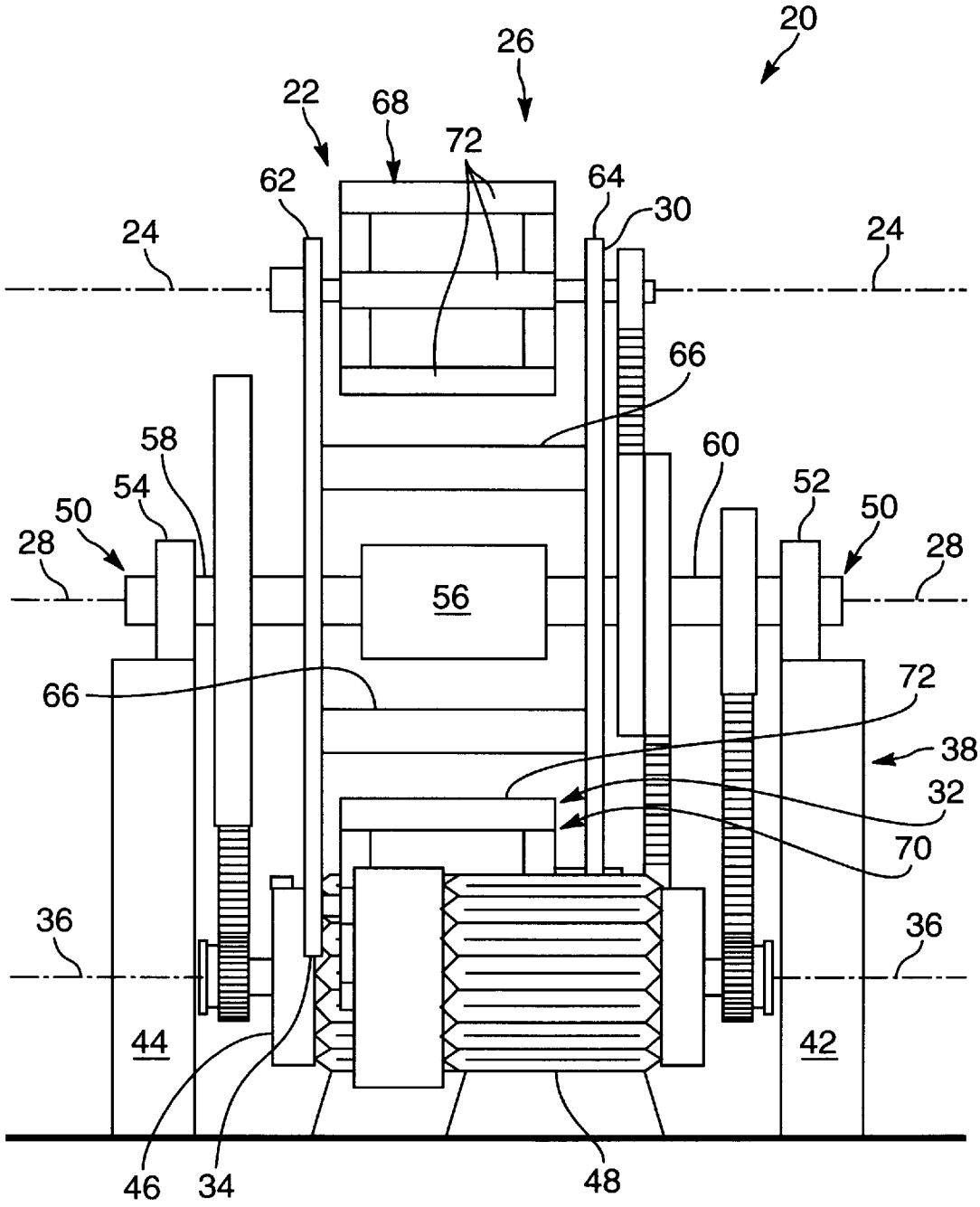
FIG. 2 is an end view of the presently preferred embodiment of the dual drive planetary mill of FIG. 1.

In one presently preferred embodiment, as shown in FIG. 1, the mill 20 may be a planetary mill 20 in that containers of the mill 20 rotate about the mill 20 in a planetary-type motion. The planetary mill 20 further includes a second container 32 rotatably mounted at a second end 34 of the gyration arm 26. The second container 32 rotates about a third axis 36, which is different from the first and second axes 24, 28. As shown in FIGS. 1 and 2, the first, second, and third axes 24, 28, 36 are all substantially parallel to each other. Moreover, the first and third axes 24, 36 are preferably substantially equidistant from the second axis 28.

A support frame 38 is preferably used in the planetary mill 20 of FIG. 1 to support the mill 20. The support frame 38 may include a base member 40 on which the planetary mill 20 is mounted. As shown in FIG. 1, the base member 40 is substantially rectangular and flat so as to sit substantially flush with the ground, floor, or surface on which the planetary mill 20 is operating. The support frame 38 may further include a first stand 42 and a second stand 44 connected to the base member 40 so as to support the moving parts of the planetary mill 20, to be more fully disclosed herein.

The planetary mill 20 also includes means for rotating the gyration arm 26 about the second axis 28. In the mill 20 of FIG. 1, the means for rotating the gyration arm 26 is a first motor 46 mounted to the support frame 38, and more particularly to the base member 40. The first motor 46 and supporting parts used to turn the gyration arm 26 will be more fully discussed in relation to FIG. 3.

Means for rotating the first and second containers 22, 32 about their respective axes 24, 36 are also preferably provided. As will be appreciated, separate means could be provided for rotating the first container 22 independently of the second container 32. However, in one presently preferred embodiment, the means for rotating the first and second containers 22, 32 is one and the same. Thus, in such presently preferred embodiment, a second motor 48 serves as the means for rotating both of the containers 22, 32. The second motor 48 and supporting parts used to turn the containers 22, 32 will be more fully discussed in relation to FIG. 4.

FIG. 2 is an end view of the presently preferred embodiment of the dual drive planetary mill 20 of FIG. 1. As shown in FIG. 2, the planetary mill 20 is operating in a batch mode as the quantity of material to be ground in one operational cycle is limited to that material which can be placed within the containers 22, 32. However, the present invention is capable of operating in a continuous mode as well as a batch mode. The continuous mode capability, and the features that facilitate such continuous mode, will be pointed out more particularly with respect to FIGS. 6 and 7. Therefore, the illustration of FIG. 2 is shown as if the planetary mill 20 is operating in the batch mode.

FIG. 2 illustrates the shaft 50 axial with the second axis 28 about which the gyration arm 26 rotates. The shaft 50 is rotatably mounted to the support frame 38. The shaft 50 is rotatably mounted to the first stand 42 by a bearing and collar 52. The first stand collar 52 is fixed to the first stand 42. A bearing is mounted within the first collar 52. The shaft 50 end fits into the bearing and rotates therein, shown more fully in FIG. 6. The shaft 50 is rotatably mounted to the second stand 44 by a similar bearing and collar 54 assembly. The second stand collar 54 is fixed to the second stand 44. A bearing is mounted within the second collar, and the other shaft 50 end fits into the bearing and rotates therein, shown more fully in FIG. 6.

To facilitate friction free and smooth operation of the presently preferred embodiment, the shaft 50 is a split shaft 50. A split shaft coupling 56 serves to align the shaft 50 and enable independent rotations of the different shaft components. The shaft 50 includes a first shaft component 58 and a second shaft component 60. The split shaft coupling 56 and the split shaft 50 will be more fully discussed in relation to FIG. 5.

The gyration arm 26 includes a first arm component 62 and a second arm component 64. The arm components 62, 64 are in a spaced apart relationship, as shown in FIG. 2, and are substantially parallel. The first and second arm components 62, 64, in current design, are held in a parallel and spaced apart relationship by struts 66. The struts 66 may be fixed to the arm components 62, 64 in a variety of ways, as will be appreciated by those skilled in the art. For example, bolts, screws, a weld, and the like could be used. In the presently preferred embodiment, the struts 66 are bolted to the arm components 62, 64.

It will be appreciated by those skilled in the art that the gyration arm 26 may be designed and implemented in variety of ways. Although the presently preferred gyration arm 26 includes the first arm component 62 and the second arm component 64 such that the gyration arm 26 is roughly rectangular, the gyration arm 26 could be implemented in other forms. For example, the gyration arm 26 may include a first spherical disc (not shown) functioning similar to the first arm component 62, and a second spherical disc (now shown) functioning similar to the second arm component 64. These discs (not shown) may hold bearings that facilitate the necessary motions of the gyration arm 26. The gyration arm 26 serves to provide the planetary motion, while allowing the individual containers 22, 32 to rotate on their respective axes. Accordingly, gyration arms 26 providing this feature are considered to be within the scope of the present invention.

Also shown in FIG. 2 are cages that preferably hold the containers substantially in place. A first cage 68 may hold the first container 22, and a second cage 70 may hold the second container 32. Each cage 68, 70 may comprise a series of bars 72. In current design, each cage 68, 70 includes four U-shaped bars 72 positioned as shown in FIGS. 1 and 2. The bars 72 are positioned to hold the container firmly in place. By removing one or more bars 72, the container may be placed into or taken out of its associated cage.

Figure 3:
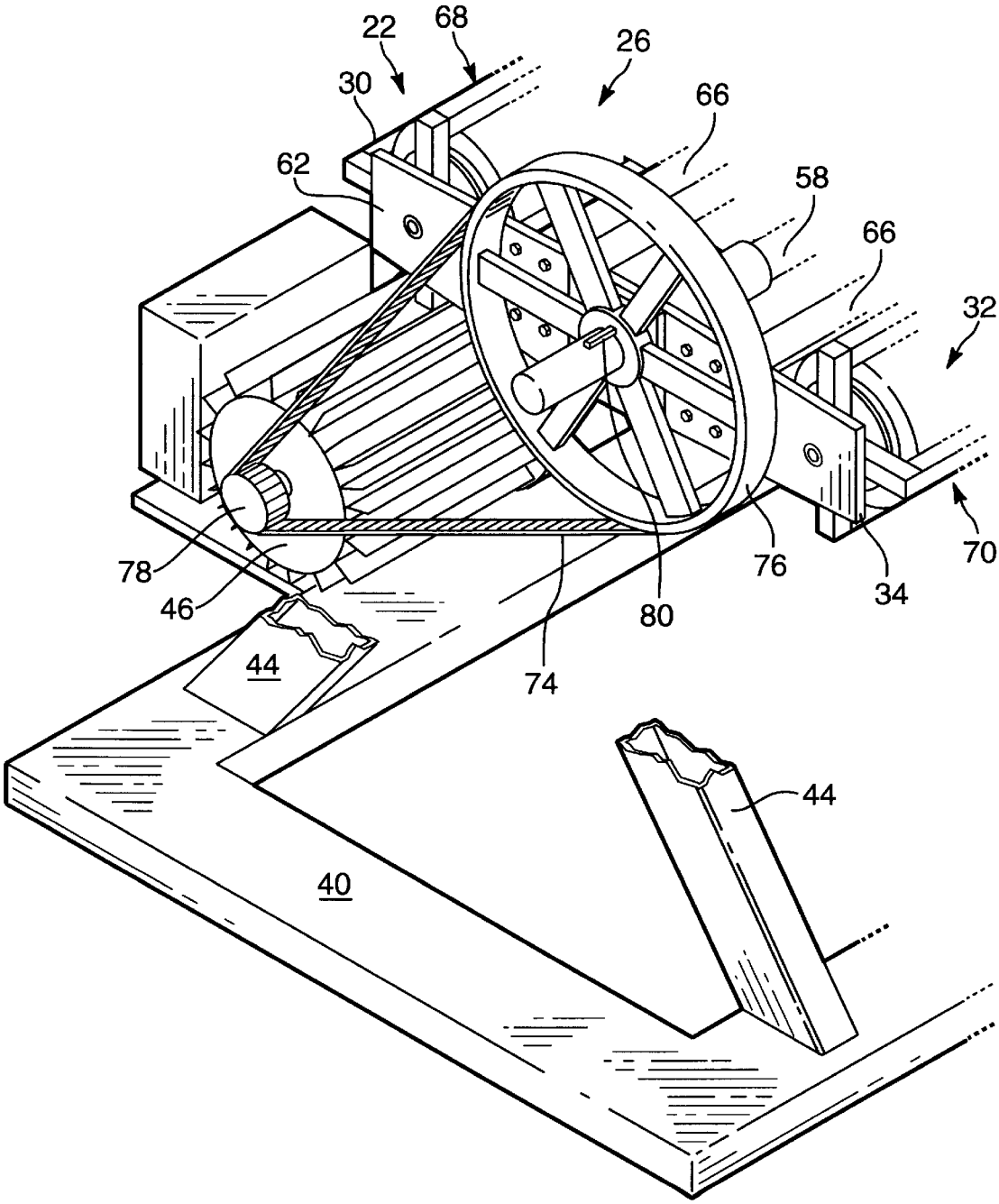
FIG. 3 is a partial, cutaway, perspective view of the mechanical linkage used in the presently preferred embodiment of the dual drive planetary mill of FIG. 1 to drive the gyration arm.

FIG. 3 illustrates the first motor 46 and supporting parts used to turn the gyration arm 26. As shown, the first motor 46 is coupled to the gyration arm 26 by a first belt 74 and a first pulley 76. The first belt 74 rotatably connects the first motor 46 to the first pulley 76 such that when a first motor pulley 78 rotates the first pulley 76 correspondingly rotates.

As the first pulley 76 rotates, a portion of the shaft 50, the first shaft component 58, also rotates. The first pulley 76 rotating causes the first shaft component 58 to turn because the first shaft component 58 and the first pulley 76 are fixed in relation to each other by a slot and key method. A slot is formed in the pulley. A corresponding slot is formed in the shaft. When these slots are aligned, a key 80 is placed in the slots to fix the first pulley 76 and the first shaft component 58 in relation to one another. The key 80 is sized so as to fit within the two combined slots. It will be appreciated that there are a variety of ways to connect the first pulley 76 to the first shaft component 58. For example, rather than using the slot and key approach, the first pulley 76 could simply be bolted to the first shaft component 58.

The first pulley 76 of the presently preferred embodiment is fixed in relation to the gyration arm 26. In current design, the gyration arm 26 is fixed to the first shaft component 58 by a slot and key method, as just described. Specifically, the first arm component 62 of the gyration arm 26 is fixed in relationship to the first shaft component 58 by a slot and key. Alternatively, the first pulley 76 could simply be bolted to the first arm component 62. Because the gyration arm 26 is fixed to the first shaft component 58, the first pulley 76, first shaft component 58, and the gyration arm 26 all turn or rotate fixed in relation to one another.

In one presently preferred embodiment, the first motor 46 is a fixed speed motor. Specifically, the presently preferred first motor 46 is a 5 HP electric motor. Those skilled in the art will appreciate that the first motor 46 could be larger and/or smaller in capacity that the presently preferred motor. Further, the first motor 46 could be a variable speed motor to achieve a centrifugal force within the containers 22, 32 as desired by one operating the present invention.

Figure 4:
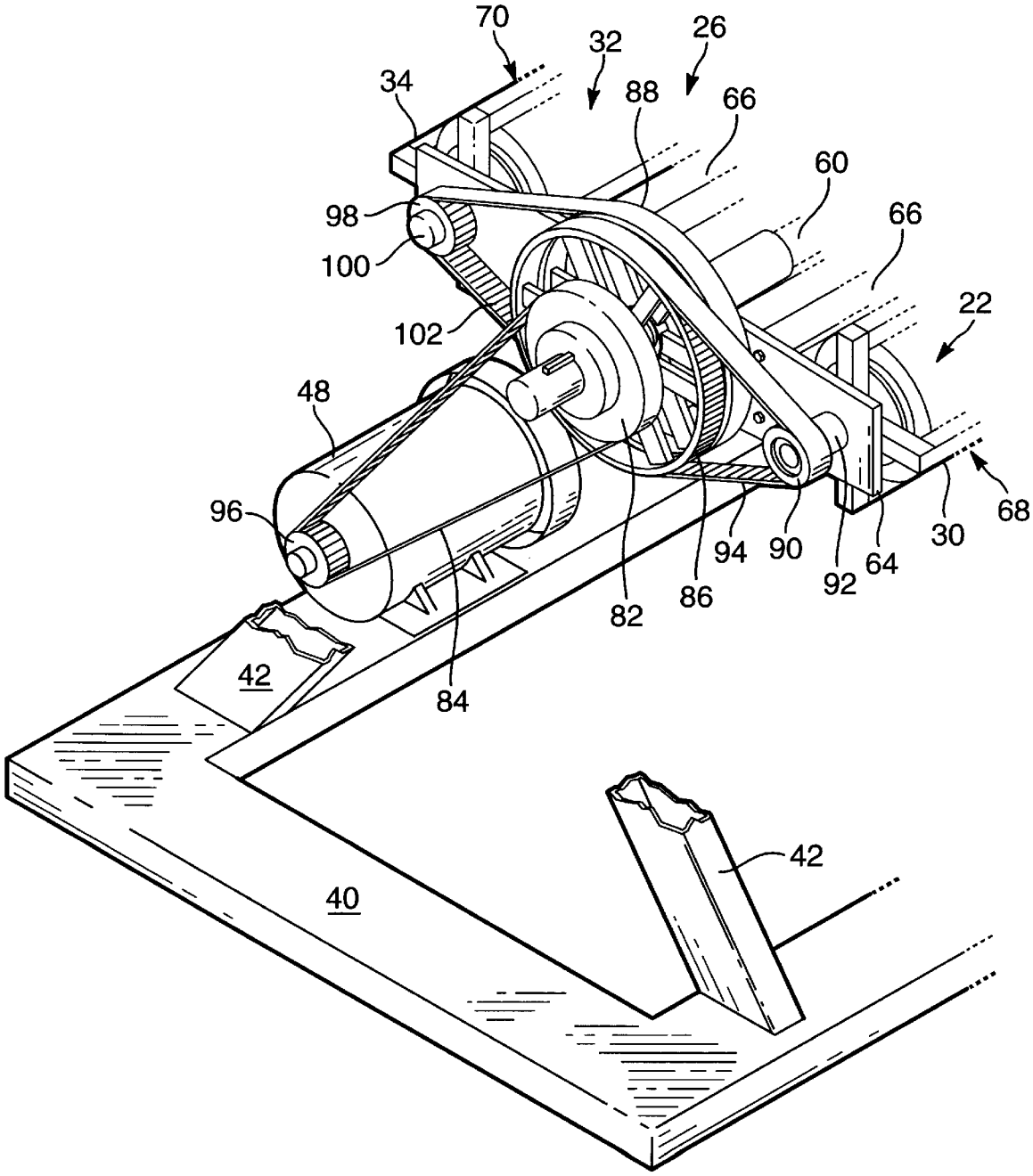
FIG. 4 is a partial, cutaway, perspective view of the mechanical linkage used in the presently preferred embodiment of the dual drive planetary mill of FIG. 1 to drive the containers.

FIG. 4 illustrates a presently preferred embodiment of the second motor 48 and supporting parts used to turn the containers 22, 32. A second pulley 82 is coupled to the second motor 48 by a second belt 84. The second pulley 82 rotates about the second axis 28. The second pulley 82 is fixed in relation to the second shaft component 60. In current design, the second pulley 82 is fixed in relation to the second shaft component 60 by the slot and key method, as described in relation to FIG. 3.

Two additional pulleys are fixed in relation to the second shaft component 60. As shown, a third pulley 86 and a fourth pulley 88 are both fixed to the second shaft component 60 and are both rotatable about the second axis 28. The third and fourth pulleys 86, 88 may both be fixed to the second shaft component 60 by bolting the pulleys 86, 88 directly to the shaft 60. In current design, the third and fourth pulleys 86, 88 are fixed to the second shaft component 60 by the slot and key method.

Figure 5:
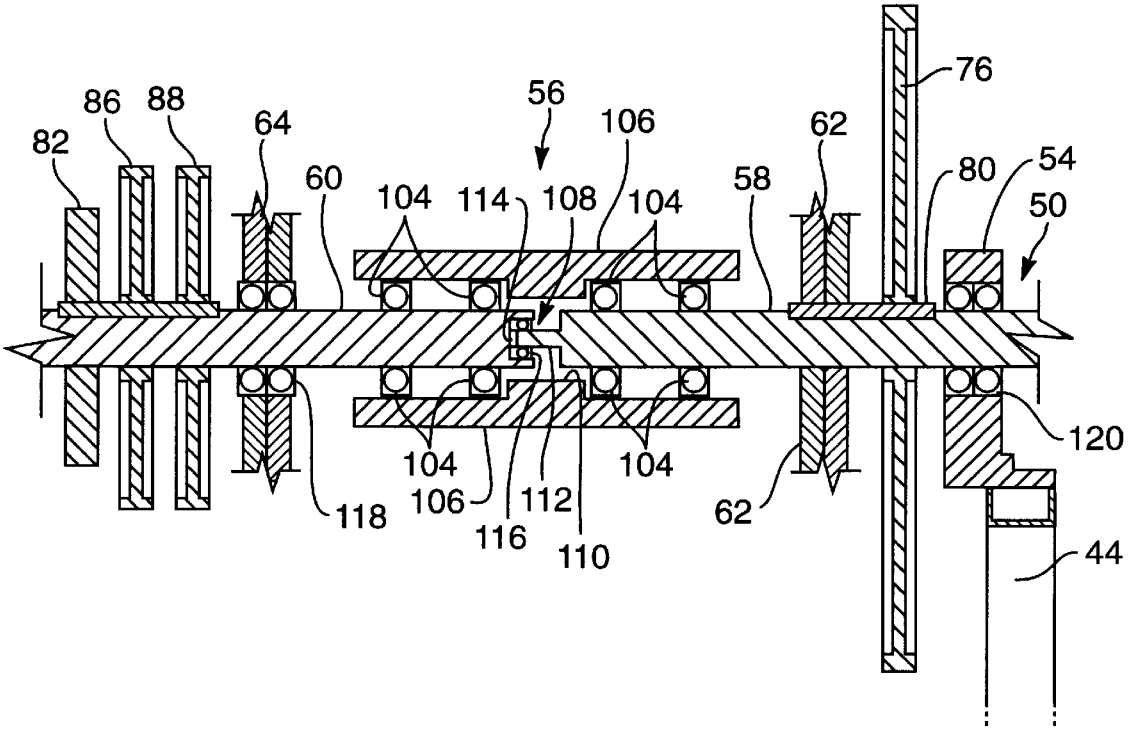
FIG. 5 is a cross-sectional view of the split shaft of the presently preferred embodiment of the dual drive planetary mill of FIG. 1.

In one presently preferred embodiment, the second pulley 82, the second shaft component 60, the third pulley 86, and the fourth pulley 88 are all coupled to one another so as to rotate at substantially the same revolutionary speed. However, the rotation of the second shaft component 60 and its associated pulleys does not cause the second arm component 64 of the gyration arm 26 to rotate. As shown in FIG. 5, the second arm component 64 includes a bearing such that the second shaft component 60 may freely rotate within the bearing without causing the second arm component 64 to rotate. As described in relation to FIG. 3, the gyration arm 26 rotates because of and with the rotation of the first pulley 76. However, the second pulley 82, in current design, does not rotate with the first pulley 76; rather, the second pulley 82 rotates independently of the first pulley 76. This independent rotation is facilitated by the split shaft 50, which will be further discussed in relation to FIG. 5.

The second motor 48 operates to turn the first and second containers 22, 32. As stated, the second motor 48 is coupled with the second pulley 82 by the second belt 84 such that the second motor 48 drives the second pulley 82. The second pulley 82 is indirectly coupled to pulleys that are coupled to the containers whereby rotation of the second pulley 82 causes the containers 22, 32 to spin about their respective axes 24, 36.

A first container pulley 90 is connected to the first container 22 such that rotating the first container pulley 90 causes the first container 22 to rotate. The first container pulley 90 rotates about the first axis 24. A bearing placed axially along the first axis 24 in the second arm component 64 allows the first container pulley 90 and a first container pulley shaft 92 to be rotatably connected to the second arm component 64. The first container pulley shaft 92 connects the first container pulley 90 to the first container 22.

The first container pulley 90 is coupled to the third pulley 86 by a third belt 94. In operation, a second motor pulley 96 rotates thereby turning the second belt 84. The second belt 84, in turn, causes the second pulley 82 to rotate about the second axis 28. Rotation of the second pulley 82 causes the second shaft component 60 to correspondingly rotate. Because the third pulley 86 is fixed relative to the second shaft component 60, the third pulley 86 also rotates with the second pulley 82 thereby causing the third belt 94 to turn. The third belt 94, being coupled to the first container pulley 90, causes the first container pulley 90 to rotate, which in turn rotates the first container 22. The mechanical linkage operation used to rotate the second container 32 operates similarly to the linkage operation used to rotate the first container 22.

A second container pulley 98 is connected to the second container 32 such that rotating the second container pulley 98 causes the second container 32 to rotate. The second container pulley 98 rotates about the third axis 36. A bearing placed axially along the third axis 36 in the second arm component 64 allows the second container pulley 98 and a second container pulley shaft 100 to be rotatably connected to the second arm component 64. The second container pulley shaft 100 connects the second container pulley 98 to the second container 32.

The second container pulley 98 is coupled to the fourth pulley 88 by a fourth belt 102. In operation, the second motor pulley 96 rotates thereby turning the second belt 84. The second belt 84, in turn, causes the second pulley 82 to rotate about the second axis 28. Rotation of the second pulley 82 causes the second shaft component 60 to correspondingly rotate. Because the fourth pulley 88, like the third pulley 86, is fixed relative to the second shaft component 60, the fourth pulley 88 also rotates with the second pulley 82 thereby causing the fourth belt 102 to turn. The fourth belt 102, being coupled to the second container pulley 98, causes the second container pulley 98 to rotate, which in turn rotates the second container 32.

A variety of motors may be used as the second motor 48. In one presently preferred embodiment, the second motor 48 is a variable speed motor, and more preferably, a 5 HP variable speed electric motor. By use of a variable speed motor a preferred rotational speed of the containers 22, 32 can be achieved. Those skilled in the art will appreciate that the rotational speed of the containers 22, 32 is chosen in relation to the rotational speed of the gyration arm 26 to achieve grinding action within the containers 22, 32.

FIG. 5 illustrates a cross-sectional view of one presently preferred embodiment of the split shaft 50 of the present invention which is employed in the embodiment of FIG. 1. The split shaft 50 comprises a first shaft component 58 and a second shaft component 60. As illustrated and explained in relation to FIGS. 3 and 4, the first shaft component 58 rotates with the first pulley 76, and the second shaft component 60 rotates with the second pulley 82. The shaft components 58, 60 are independently rotatable. That is, the rotation of the components 58, 60 are not necessarily synchronized. However, the shaft components 58, 60 do share a common axis: the second axis 28.

The shaft components' 58, 60 ability to share an axis 28 and yet rotate independently is facilitated by the split shaft coupling 56. The split shaft coupling 56 operates to hold both shaft components 58, 60 along a common axis, and also allow them to freely rotate independently of each other. In one presently preferred embodiment, the split shaft coupling 56 comprises four bearings 104, a collar 106, and a rotatable coupling 108 between the shaft components 58, 60.

Two bearings 104 are located on the first shaft component 58, and two other bearings 104 are located on the second shaft component 60. A collar 106 contains the bearings 104 and holds them substantially in place so that the shafts 58, 60 rotating therein will have a common axis. The collar 106 and bearings 104 serve to align the shaft components 58, 60 without requiring them to have synchronous rotations. Through the bearings 104 and the collar 106, the first shaft component 58 may rotate independently of the second shaft component 60.

The bearings 104 within the collar 106 are preferably press fit bearings. A shoulder 110, a protrusion along the center inner periphery of the collar 106, enables the inner bearings 104 to be appropriately placed within the collar 106, without placing them to far inward. The inside diameter (the inside ring of the bearings) of the bearings 104 within the collar 106 are attached to the shaft 50 by set screws (not is shown). This keeps the shaft components 58, 60 from separating.

The rotatable coupling 108 between the first shaft component 58 and the second shaft component 60 serves to align the components 58, 60. The first shaft component 58 includes a protruding end 112 that is cylindrical with a diameter smaller than that of the first shaft component 58. The second shaft component 60 is hollowed out at its end proximate the first shaft component 58. Within this hollowed out portion 114 is placed a bearing 116. The protruding end 112 of the first shaft component 58 extends into the bearing 116 such that the protruding end 112 will rotate within the bearing 116. Thus, the rotatable coupling 108 further serves to align the first and second shaft components 58, 60.

Also illustrated in FIG. 5 is the bearing 118 (or bearings) located on the second arm component 64. The bearing 118 allows the second shaft component 60 to freely spin about the second axis 28 without causing the second arm component 64 to rotate.

The shaft components 58, 60 are rotatably mounted to the support frame 38 through the use of bearings 120. FIG. 5 illustrates the first shaft component 58 being rotatably mounted to the support frame 38 through the bearing 120 mounted within the second collar 54. The second shaft component 60 is similarly rotatably mounted to the first collar 52 by a bearing. So mounted, the shaft 50 may freely rotate within the bearings 120 while the support frame 38 remains stationary.

The first arm component 62 is fixed in relation to the first shaft component 58. This may be accomplished by a slot and key arrangement 80, as shown. The first pulley 76 is fixed in relation to the first shaft component 58 by a slot and key 80 as well. So attached, the first pulley 76, first shaft component 58, and first arm component 62 all rotate synchronously. FIG. 5 also illustrates the presently preferred method of fixing the second, third, and fourth pulleys 82, 86, 88 relative to the second shaft component 60 by the slot and key method.

The split shaft 50 enables the presently preferred apparatus to operate in a continuous mode while exhibiting the dual drive nature of the present invention. The first shaft component 58 spins about its axis 28 fixed in relation to the first pulley 76 also turning about this axis 28. The turning of the first shaft component 58 effects the rotation of the gyration arm 26. However, the second shaft component 60 spins about its axis 28 fixed in relation to the second pulley 82 which is driving the rotations of the individual containers 22, 32. Thus, the split shaft 50 enables the two different driving mechanisms to drive the gyration arm 26 and the individual containers 22, 32 using the same axis 28 because the split nature of the shaft 50 allows the shaft components 58, 60 to rotate independently of one another. Furthermore, allowing the first shaft component 58 to rotate with the gyration arm 26 facilitates the feeding of the material to be ground into the containers 22, 32 through conduits.

If one only wished to operate the mill 20 in a batch mode, the shaft 50 would not need to be a split shaft 50. For example, in an alternative design made particularly for a batch mode, the shaft 50 could be simply one shaft that rotates with the second, third, and fourth pulleys 82, 86, 88. The first pulley 76 would be fixed to the first arm component 62 directly. In addition, the first pulley 76 and the first arm component 62 would rotate about the shaft 50 by bearings (these bearings not shown). Thus, the first pulley 76 would cause the gyration arm 26 to rotate about the shaft 50, without turning the shaft 50. At the same time, the second, third, and fourth pulleys 82, 86, 88 would rotate together with the shaft 50. However, to operate in continuous mode, the present invention would need other features, such as the features as described herein, or their structural and/or functional equivalents.

Figure 6:
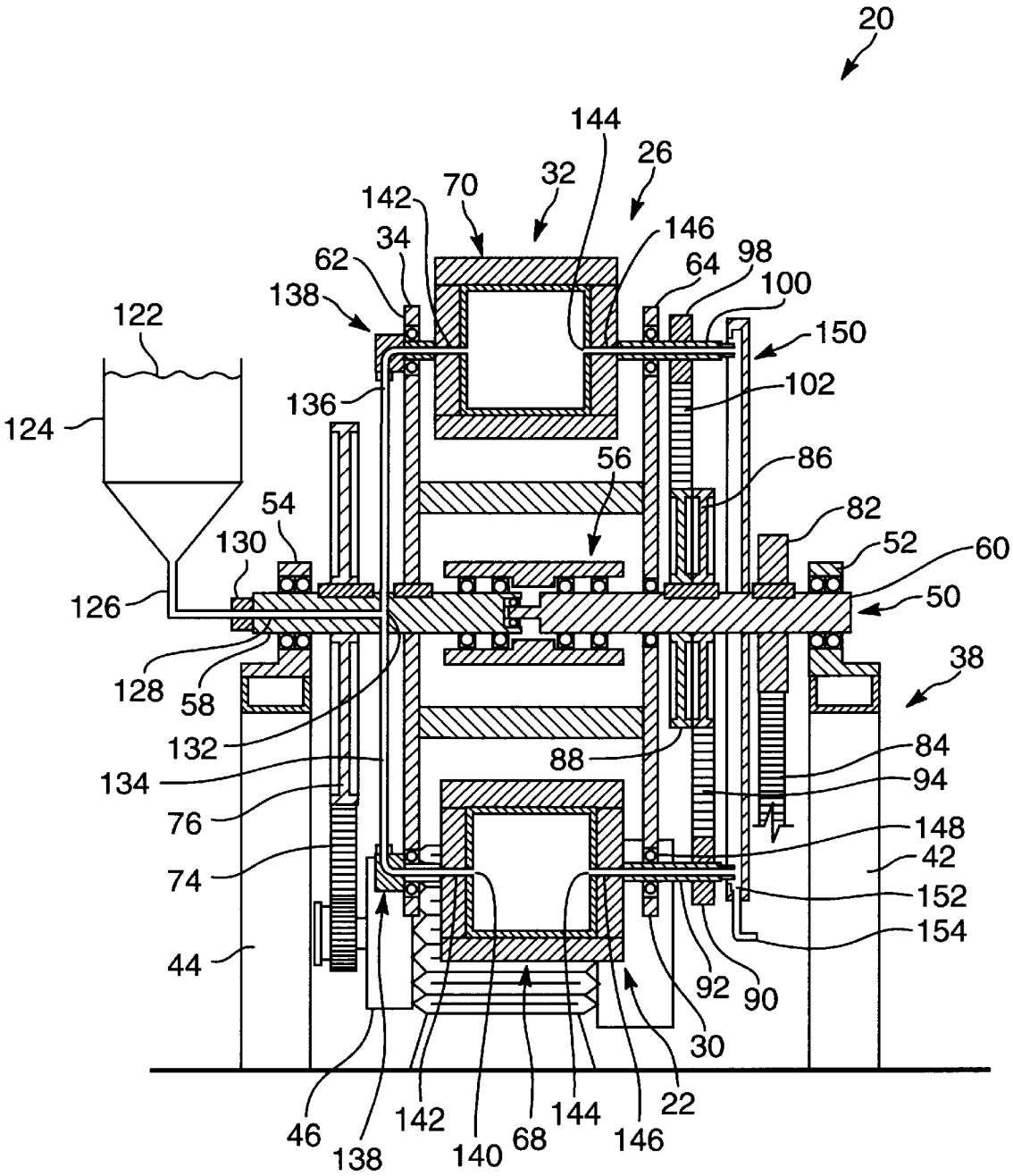
FIG. 6 is a cross-sectional view of the presently preferred embodiment of the dual drive planetary mill of FIG. 1 modified to operate in a continuous mode.

FIG. 6 is a cross-sectional view of the presently preferred embodiment of the dual drive planetary mill 20 of FIG. 1 operating in a continuous mode. To operate in a continuous mode, the planetary mill 20 needs a supply 122 of material to be ground and/or mixed. The supply 122 of material to be ground and/or mixed may be provided in a variety of different ways. In one presently preferred embodiment, the supply 122 of material to be ground is placed into a tank 124. The material in the supply tank 124 is preferably mixed with a liquid (such as water) to form a slurry. The liquid slurry provides a more efficient way to feed the material into the containers 22, 32. In one presently preferred embodiment, the material to be ground, in a solid powder form, is mixed with water and held in the tank 124. Of course, it will be appreciated that other carriers may be used to carry the material to be ground. For example, liquids other than water may be used to create the slurry. In addition, the material to be ground and/or mixed may be mixed with air or gas, instead of liquid, and then fed into the containers 22, 32 for grinding and/or mixing. The slurry is continuously fed from the tank 124 to the mill 20 for grinding and/or mixing, and then continuously discharged therefrom.

The supply 122 of material is in fluid communication with the containers 22, 32 so that the material to be ground may be continuously fed to the containers 22, 32, at a desired rate. The containers 22, 32 comprise means for feeding the material to be ground into the containers 22, 32. The supply 122 of the material is in fluid communication with the means for feeding. It will be appreciated that there are different ways to accomplish the means for feeding. Following is one presently preferred method for feeding the material to be ground into the containers 22, 32 and for allowing ground material to be expelled from the containers 22, 32.

Preferably, the slurry is kept in a well agitated tank 124 so that the slurry will be kept substantially mixed and the solid powder will not settle out. The slurry is fed into a feeding tube 126 at a desired rate. The feeding tube 126 leads into a channel 128 in the gyration shaft 50. The feeding tube 126 is in fluid communication with the channel 128 by use of a rotary joint 130. The rotary joint 130 allows the gyration shaft 50, and hence the channel 128 inside the shaft 50, to rotate while providing a sealed connection to the feeding tube 126. The feeding tube 126, in current design, is not rotating. The rotary joint 130 used to fluidly couple the feeding tube 126 and the channel 128 can be purchased by vendors of rotary joints. One presently preferred rotary joint 130 is manufactured by Duff-Norton. It will be appreciated that many different types of rotary joints could be used with the present invention.

The channel 128 is disposed in the first shaft component 58 and leads toward the center of the split shaft 50. When the channel 128 reaches the approximate location of the first arm component 62, it 128 branches out to both containers 22, 32. As shown in FIG. 6, a T-junction 132 fluidly connects a first conduit 134 to the channel 128 and connects a second conduit 136 to the channel 128 in similar fashion. The conduits 134, 136, tubes in current design, carry the slurry from the channel 128 in the gyration shaft 50 to the containers 22, 32.

The first conduit 134 is in fluid communication with the channel 128. As described in relation to FIG. 3, the first shaft component 58 rotates with the first pulley 76 and with the gyration arm 26. Accordingly, the channel 128 fluidly connects to the first conduit 134 without need for a rotary joint at this junction 132 because the first shaft component 58, effectively the channel 128, and the gyration arm 26, to which the first conduit 134 is attached to, are substantially fixed in relation to one another.

A container rotary joint 138 is used in the presently preferred embodiment to connect the first conduit 134 to an inlet 140 of the first container 22. The rotary joint 138 allows the first conduit 134 to be in fluid communication with an inlet 140 of the container 22. The rotary joint 138 also provides a sealed channel for the slurry to travel through. This rotary joint 138 will be more fully discussed in relation to FIG. 9.

The slurry travels through the rotary joint 138, through an inlet tube 142, and into the inlet 140 of the first container 22. Once inside the container 22, the material in the slurry is pulverized and/or mixed by the milling operation. As fresh slurry is fed into the first container 22, ground and/or mixed material is also forced out of the container 22. Thus, the presently preferred embodiment of the planetary mill 20 operating in a continuous mode, and particularly the containers used to mill the material to be ground, comprise means for expelling the ground material from the containers 22, 32.

The ground material is expelled through an outlet 144 of the first container 22. The outlet 144, in current design, is in fluid communication with a protruding tube 146. This protruding tube 146 is axial with the first axis 24. Further, the protruding tube 146 spins with the first container 22. A bearing 148 in the second arm component 64 facilitates this rotation. As described in relation to FIG. 4, the second pulley 82 effectively turns the third and fourth pulleys 86, 88. The third and fourth pulleys 86, 88, through the third and fourth belts 94, 102, turn the container pulleys 90, 98. The first container pulley 90 has an axis coinciding with the protruding tube 146. The turning of the first container pulley 90 turns the protruding tube 146 because the protruding tube 146 is fixed in relationship with the first container pulley 90. The outlet 144 and protruding tube 146 will be more fully discussed in relation to FIG. 10. Material forced out of the protruding tube 146 travels therethrough and is subsequently collected.

Referring again to FIG. 6, the fluid communication from the supply 122 to the second container 32 is accomplished in a fashion substantially similar to that of the first container 22. A second conduit 136 connects the channel 128 to an inlet tube 142 for the second container 32 through a container rotary joint 138. After the material is ground and/or mixed in the second container 32, and as new material is forced into the container 32, material is forced out of the container 32 through an outlet 144 and a protruding tube 146.

Like the outlet shaft 168 of the first container 22, the outlet shaft 168 of the second container 32 effectively turns the second container 32 as a result of the fixed relationship between the outlet shaft 168 and the second container pulley 98. The second container pulley 98 turns because of the coupling of the fourth belt 102, which is turning because of its coupling to the fourth pulley 88.

The method of collecting the product slurry is accomplished through means for receiving the ground material. In one presently preferred embodiment, a stationary collection ring 150 is located centrally over the gyration shaft 50. The collection ring 150 is closed on the outside but substantially open on the side facing the containers 22, 32.

The protruding tubes 146 not only spin around their own axes, but in addition they are rotating about the second axis 28. As a result of rotating about the second axis 28, both protruding tubes 146 travel near the perimeter of the collection ring 150 and they both travel in a circular motion near the perimeter of the collection ring 150.

With the collection ring 150 positioned as shown in FIG. 6, the slurry coming out of the containers 22, 32 is expelled into the collection ring 150. The collected slurry gathers toward the bottom of the collection ring 150. In the presently preferred embodiment, the collection ring 150 includes a hole 152 out of which the collected slurry may drain. In addition, a spout 154 may be disposed in fluid communication with the hole 152 such that the collected slurry may be purposely directed toward a further collection device (not shown), connected to a tube (not shown), or similar means to further collect the slurry.

Figure 7:
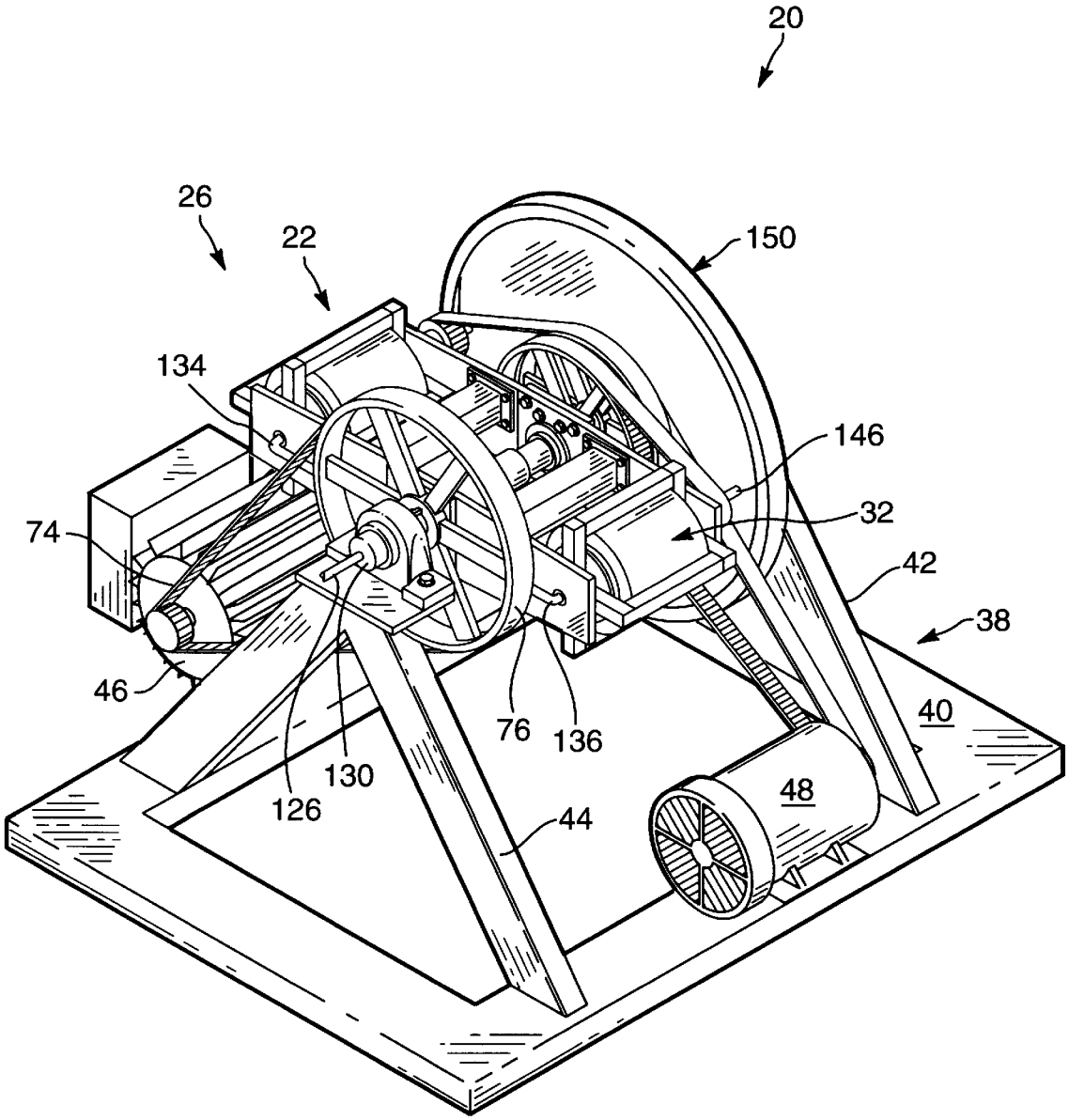
FIG. 7 is a perspective view of the presently preferred embodiment of the dual drive planetary mill of FIG. 1 modified to operate in a continuous mode.

FIG. 7 is a perspective view of the presently preferred embodiment of the dual drive planetary mill 20 operating in a continuous mode. FIG. 7 more fully illustrates the circular nature and position of the collection ring 150. The diameter of the collection ring 150 is slightly larger than the distance between the protruding tube 146 of the first container 22 and the protruding tube 146 of the second container 32.

Figure 8:
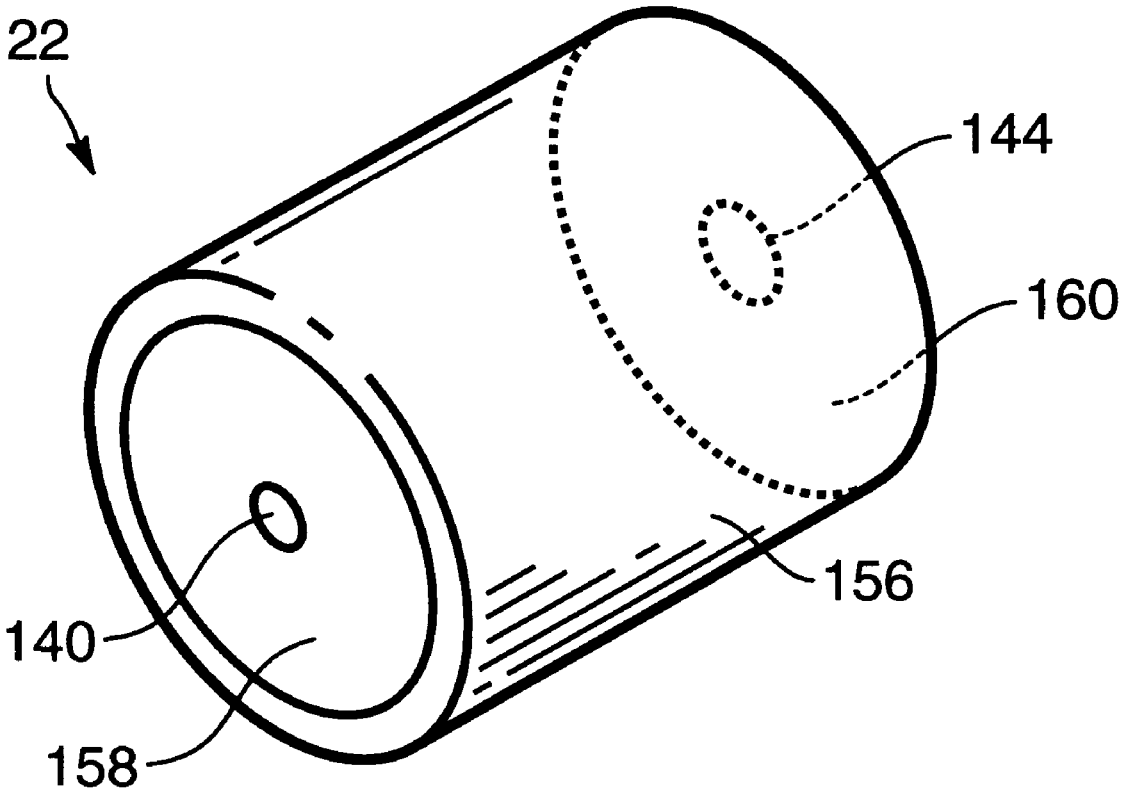
FIG. 8 is a perspective cutaway view of a presently preferred embodiment of a container within the scope of the present invention which may be used, for example, with the presently preferred embodiment of the dual drive planetary mill of FIG. 1.

As illustrated in FIG. 8, the container 22 is preferably cylindrical in nature. Although the first container 22 is shown in FIG. 8, it will be appreciated that the second container 32 is fashioned in substantially the same manner as the first container 22. Accordingly, the elements included with the first container 22 are the same as, or similar to, the elements included with the second container 32.

The container 22 includes a body 156, a feed end plate 158, and a discharge end plate 160. In current design, the body 156 is cylindrical. Each end plate 158, 160 may be placed onto the body 156 in a wide variety of ways. In the presently preferred embodiment, the end plates 158, 160 are bolted to the body 156. The slurry is fed into the container 22 through the feed end plate 158. Accordingly, the inlet 140 is disposed in the feed end plate 158. The inlet tube 142 is disposed in fluid communication with the inlet 140 so that slurry flowing through the inlet tube 142 will flow into the inlet 140 and into the container 22.

The slurry, after it has been ground and/or mixed, exits the container 22 through the discharge end plate 160. In particular, the ground material and slurry exits through the outlet 144 positioned in the discharge end plate 160. The protruding tube 146 is in fluid communication with the outlet 144 to facilitate the slurry leaving the container 22.

Because of the rotations of the containers 22, 32, and because of the rotation of the gyration arm 26, the containers 22, 32 undergo, at times, significant mechanical and centrifugal forces. The containers 22, 32 of the presently preferred embodiment are thus preferably encased in silicone rubber to withstand the mechanical forces arising from the centrifugal acceleration. The silicone rubber also enables the cage 68, 70 to tightly bind and hold the container 22, 32 in place relative to the cage 68, 70. Those skilled in the art will appreciate that the containers 22, 32 themselves may be made of a metal, without the encasement of silicone rubber, and still withstand the forces due to centrifugal acceleration as well as provide a tight fit within the cage.

Figure 9:
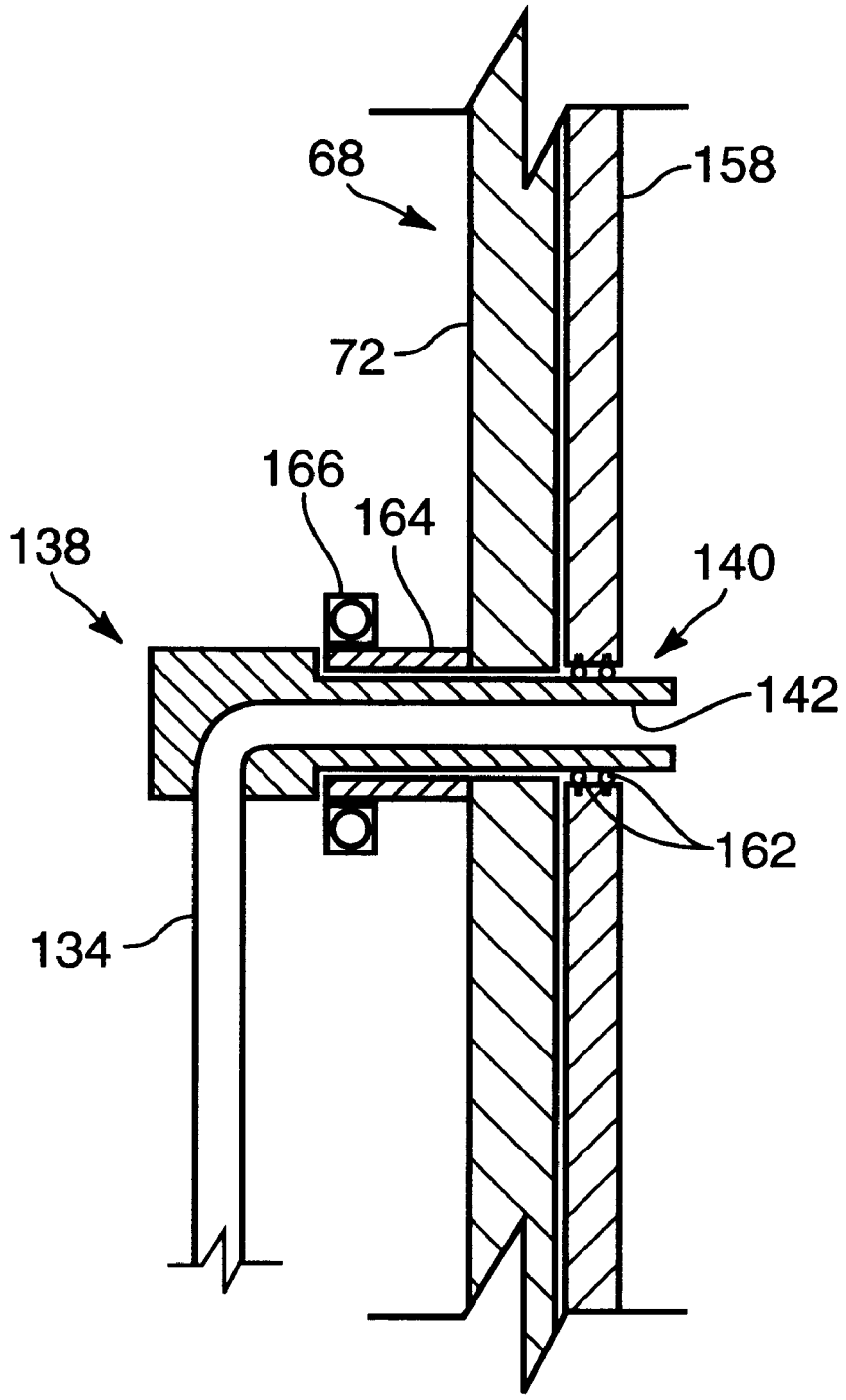
FIG. 9 is a cross-sectional view of one presently preferred embodiment of a feed end of the container of the present invention with its associated rotary joint.

FIG. 9 illustrates a side, cross-sectional view of the inlet 140, container rotary joint 138, and associated parts. The first conduit 134 is in fluid communication with the inlet tube 142. The inlet tube 142 is formed within the container rotary joint 138. The container rotary joint 138, and effectively the inlet tube 142, are substantially stationary and do not turn with the container 22. In the presently preferred embodiment, the container rotary joint 138 is made of self-lubricating bronze. It will be appreciated that other bearing materials could be used that facilitate rotation of the container 22 and cage 68 about the container rotary joint 138.

The inlet tube 142 is fluidly sealed to the inlet 140 through two O-rings 162 disposed at the inlet 140. Thus shown, the cage 68, the inlet shaft 164, and the container 22 rotate together. The inlet shaft 164 spins within a bearing 166 mounted in the first arm component 62. In the presently preferred embodiment, the container rotary joint 138 and its inlet tube 142 remain substantially stationary. However, it will be appreciated by those skilled in the art that various types of rotary joints, including those having a rotating shaft, may be used.

Figure 10:
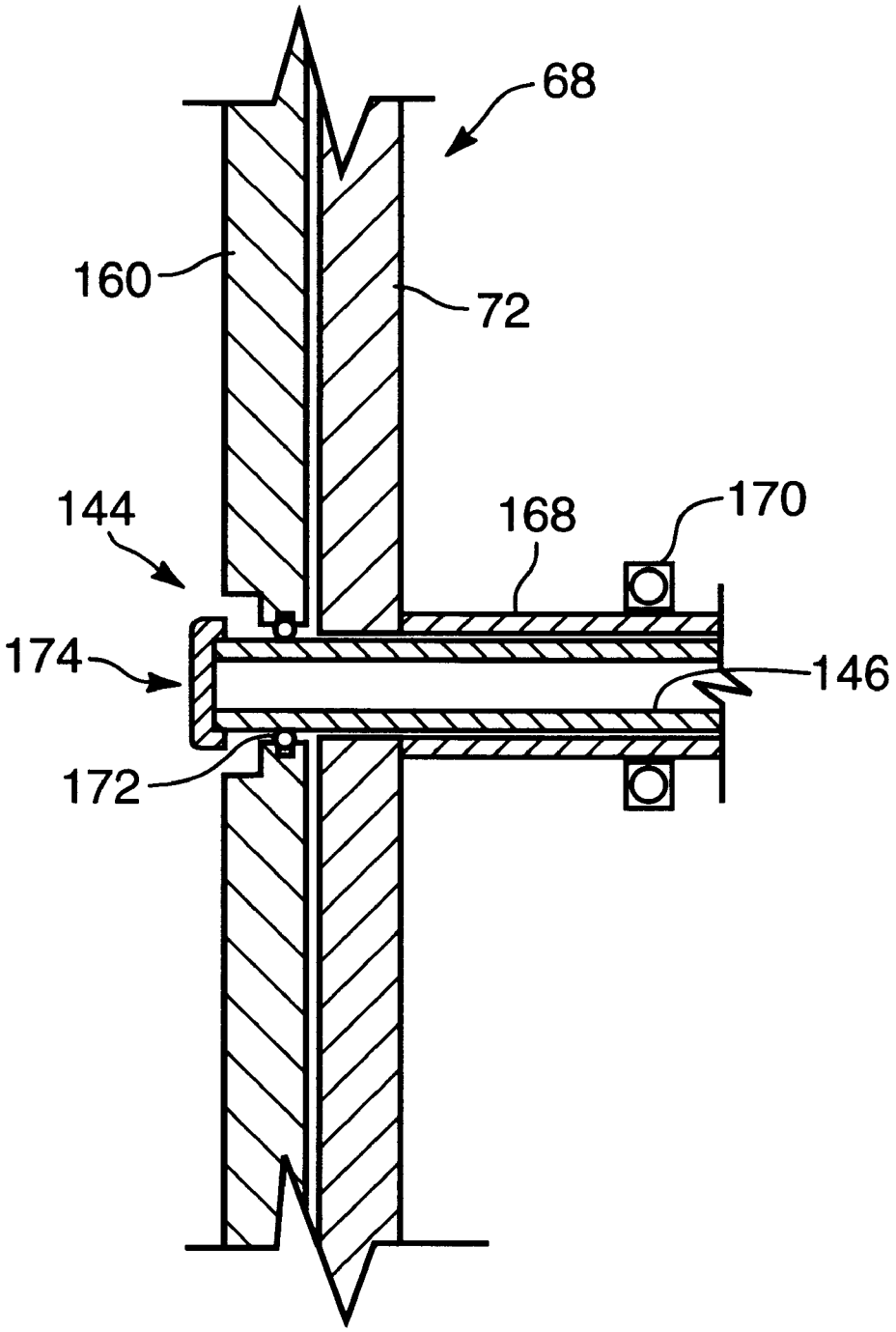
FIG. 10 is a cross-sectional view of one presently preferred embodiment of a discharge end of the container of the present invention with its associated outlet tube.

FIG. 10 is a cross-sectional view of the discharge end of the container 22 with its associated outlet or protruding tube 146. The cage 68, container 22, and outlet shaft 168 all rotate together because of the outlet shaft 168 being rotatably disposed within a bearing 170. The bearing 170 is mounted within the second arm component 64. In addition, the protruding tube 146 also rotates with the outlet shaft 168 and container 22. An O-ring 172 provides a fluid seal with the outlet 144 of the container 22.

Figure 11:
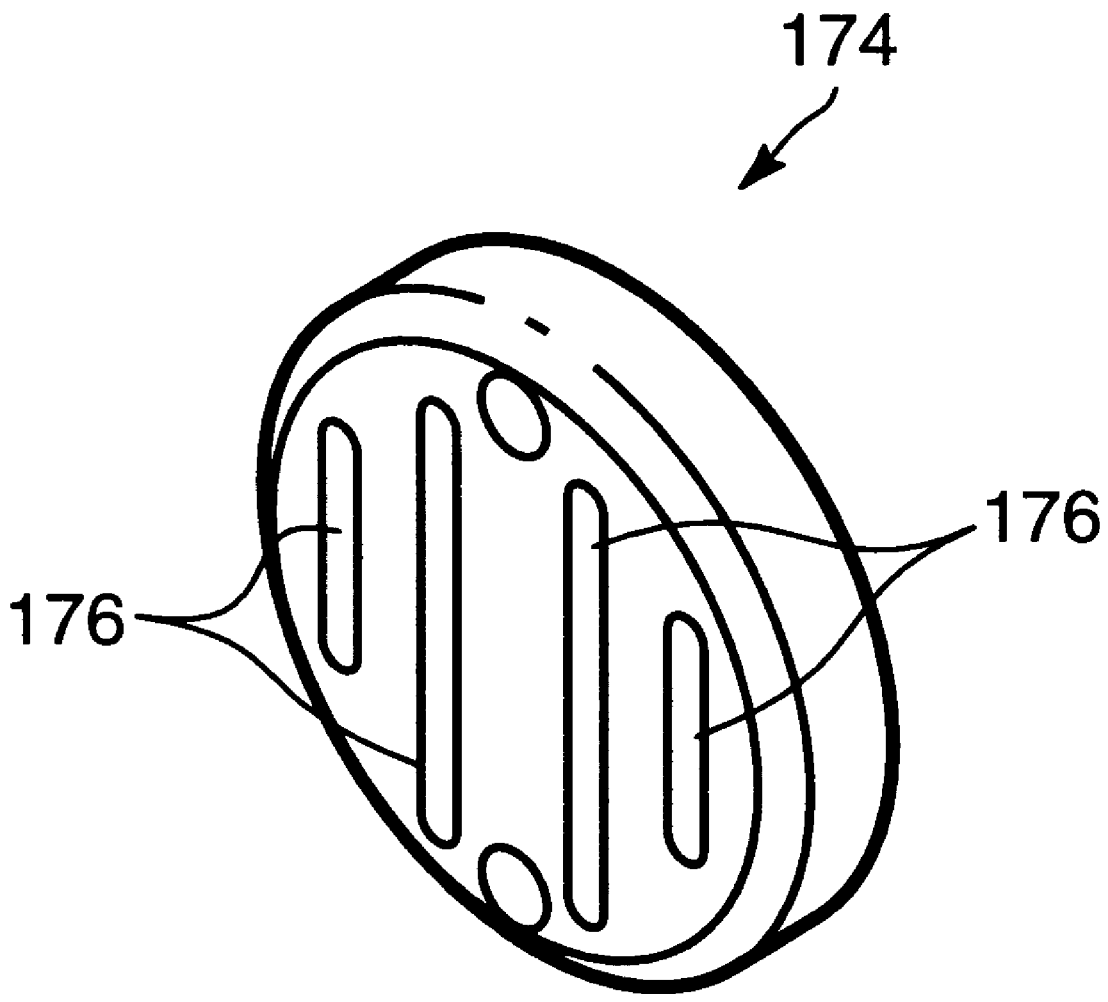
FIG. 11 is a perspective view of one presently preferred embodiment of a slotted circular ring which may be used with the presently preferred embodiment of FIG. 1 on the discharge end of the container.

A cap or ring 174 may be placed within the outlet 144. In the presently preferred embodiment, the ring 174 is a slotted circular ring 174 as shown in FIG. 11. Slots 176 are disposed in the ring 174 such that they are substantially parallel. The purpose of these slots 176 is to allow only the ground slurry to discharge through the outlet 144 while retaining the grinding ball media inside the container 22. It will be appreciated by those skilled in the art that many other embodiments of caps 174 may be used to allow the ground slurry to discharge while retaining the grinding ball media inside.

One presently preferred dual drive planetary mill 20 within the scope of the present invention includes one gyration arm 26 and two containers, one container on each end of the gyration arm 26. It will, however, be appreciated by those skilled in the art that more than one gyration arm 26 may be used within the scope of the present invention. For example, another presently preferred embodiment having two gyrations arms is shown in FIG. 12.

Figure 12:
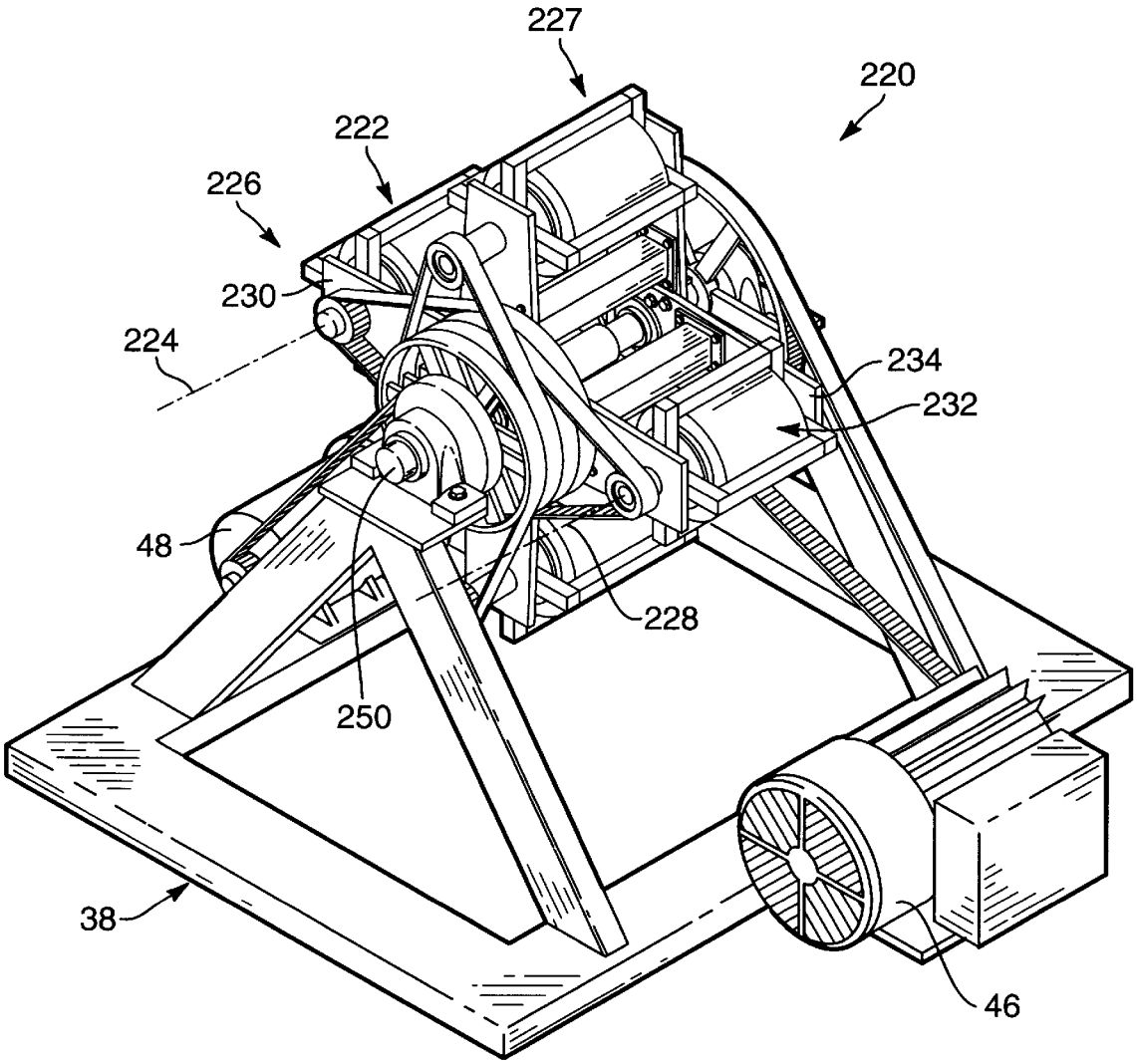
FIG. 12 is a perspective view of another presently preferred embodiment of a dual drive planetary mill within the scope of the present invention having two gyration arms and four containers.

FIG. 12 illustrates a dual drive planetary mill 220 having a first gyration arm 226 and a second gyration arm 227. The dual drive planetary mill 220 of FIG. 12 is constructed in accordance with the principles as enunciated herein. A first container 222 is rotatably mounted at a first end 230 of the first gyration arm 226 such that the first container 222 is rotatable by the second motor 48 about a first axis 224. A second container 232 is rotatably mounted at a second end 234 of the first gyration arm 226 such that the second container 232 is rotatable by the second motor 48 about a second axis 228. Similar to the preferred embodiments, the first gyration arm 226 is rotatable by the first motor 46 about the shaft 250. Thus, the planetary mill 220 of FIG. 12 is fashioned in much the same way as the planetary mill 20 of FIGS. 1 and 7 with the following modifications.

Instead of having just one gyration arm, the planetary mill 220 of FIG. 12 includes a second gyration arm 227 mounted to the support frame 38 substantially perpendicular with the first gyration arm 226. The second gyration arm 227 is rotatable by the first motor 46 about the shaft 250. As shown in FIG. 12, the containers of the second gyration arm 227 are turned about their respective axes by the second motor 48 in the same fashion as the first and second containers 222, 232, of the first gyration arm 226, are turned about their respective axes.

The gyration arms 226, 227 of FIG. 12 are substantially perpendicular to balance the planetary mill 220. If more than two gyration arms are used, the angles between the arms should be adjusted to balance the mill 220.

For example, if the planetary mill were to include three gyration arms (not shown), the angle between adjacent arms would be approximately sixty degrees. The second gyration arm would be mounted to the support frame such that a first angle (not shown) formed between the second gyration arm and the first gyration arm would be approximately sixty degrees. The third gyration arm (not shown), also mounted to the support frame, would form a second angle between the third gyration arm and the first gyration arm of approximately sixty degrees, and would form a third angle between the third gyration arm and the second gyration arm of approximately sixty degrees.

If four gyration arms were to be included with the planetary mill, the angle between adjacent arms would be approximately forty-five degrees.

It will be appreciated that each additional gyration arm increases the capacity of the mill. Using additional gyration arms enables the processing of larger volumes of slurry without increasing the necessary floor space. For example, one dual drive planetary mill with four gyration arms and eight containers effectively does the work of four individual dual drive planetary mills each operating with two containers.

One presently preferred method for grinding and/or mixing material using the present invention includes several steps. The material to be ground and/or mixed is placed into one or more containers, along with the grinding/mixing substance, usually steel or ceramic balls. The rotation of the gyration arm 26 about the second axis 28, and the rotations of the containers 22, 32 about their respective axes 24, 36, causes the grinding and/or mixing to take place.

To operate in a continuous mode, the material to be ground is continuously fed into the containers 22, 32. The material to be ground may be mixed with a liquid to create a slurry. Alternatively, the material to be ground may be mixed with air or gas. This slurry is then fed into the containers 22, 32. As the slurry is fed into the containers 22, 32, a substantially equal amount of ground and/or mixed slurry is expelled from the container 22, 32 through its outlet 144.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A planetary mill for grinding and/or mixing material comprising:

a support frame;

a first motor mounted to said support frame;

a second motor mounted to said support frame;

a gyration arm mounted to said support frame;

a first container, which holds material for grinding and/or mixing, rotatably mounted at a first end of said gyration arm such that said first container is rotatable by said second motor about a first axis;

a second container, which holds material for grinding and/or mixing, rotatably mounted at a second end of said gyration arm such that said second container is rotatable by said second motor about a second axis different from said first axis; and a split shaft transmission device having a first shaft coupled to said second motor for driving said first and second containers and a second shaft coupled to said first motor for driving said gyration arm, wherein said split shaft transmission device provides a third axis different from said first axis and different from said second axis.

2. The planetary mill as defined in claim 1 wherein said first axis, said second axis, and said third axis are all substantially parallel to each other.

3. The planetary mill as defined in claim 2 wherein said first axis and said second axis are substantially equidistant from said third axis.

4. The planetary mill as defined in claim 1 wherein said first motor is coupled to said second shaft by a belt and a pulley.

5. The planetary mill as defined in claim 1 wherein said first motor is a fixed speed motor.

6. The planetary mill as defined in claim 1 wherein said second motor is a variable speed motor.

7. The planetary mill as defined in claim 1 wherein said second motor is coupled to a first pulley by a first belt, said first pulley being rotatable about said first shaft, said first pulley being coupled to a second pulley rotatable about said first axis, and said first pulley also being coupled to a third pulley rotatable about said second axis.

8. The planetary mill as defined in claim 7 wherein said second pulley is coupled to said first container such that rotating said second pulley causes said first container to rotate about said first axis.

9. The planetary mill as defined in claim 7 wherein said third pulley is coupled to said second container such that rotating said third pulley causes said second container to rotate about said second axis.

10. The planetary mill as defined in claim 1 wherein said split shaft transmission device further comprises:

a first pulley rotatable about said second shaft and capable of driving said gyration arm;

a first belt coupling said first motor to said first pulley;

a second pulley rotatable about said first shaft;

a second belt coupling said second motor to said second pulley;

a third pulley rotatable about said first axis and coupled to said second pulley; and a fourth pulley rotatable about said second axis and coupled to said second pulley.

11. The planetary mill as defined in claim 10 wherein said third pulley is coupled to said first container such that rotating said third pulley causes said first container to rotate about said first axis.

12. The planetary mill as defined in claim 10 wherein said fourth pulley is coupled to said second container such that rotating said fourth pulley causes said second container to rotate about said second axis.

13. The planetary mill as defined in claim 10 further comprising a fifth pulley rotatable about said third axis, said fifth pulley being coupled to said second pulley and coupled to said third pulley thereby coupling said third pulley to said second pulley.

14. The planetary mill as defined in claim 13 further comprising a sixth pulley rotatable about said third axis, said sixth pulley being coupled to said second pulley and coupled to said fourth pulley thereby coupling said fourth pulley to said second pulley.

15. The planetary mill as defined in claim 1 wherein said first shaft and said second shaft are independently rotatable.

16. The planetary mill as defined in claim 15 further comprising a bearing which serves to align said first shaft and said second shaft.

17. The planetary mill as defined in claim 1 wherein said first container further comprises a first inlet, and wherein said second container further comprises a second inlet.

18. The planetary mill as defined in claim 17 further comprising a supply of the material in fluid communication with said first inlet and said second inlet.

19. The mill as defined in claim 18 further comprising:

a first rotary joint axial with said first axis facilitating fluid communication between said supply and said first inlet; and a second rotary joint axial with said second axis facilitating fluid communication between said supply and said second inlet.

20. The mill as defined in claim 19 further comprising a third rotary joint axial with said third axis facilitating fluid communication between said supply and said first and second rotary joints.

21. The mill as defined in claim 20 further comprising:

a first conduit providing fluid communication between said third rotary joint and said first rotary joint; and a second conduit providing fluid communication between said third rotary joint and said second rotary joint.

22. The planetary mill as defined in claim 21 wherein said first container further comprises a first outlet, and wherein said second container further comprises a second outlet, said first and second outlets allowing ground and/or mixed material to exit said containers.

23. The planetary mill as defined in claim 22 further comprising means for receiving the ground and/or mixed material as the ground and/or mixed material exits said outlets.

24. The planetary mill as defined in claim 23 wherein said means for receiving the ground and/or mixed material comprises a collection ring capable of continuously receiving the ground and/or mixed material.

25. The planetary mill as defined in claim 24 further comprising:

a first protruding tube in fluid communication with said first outlet facilitating fluid flow therethrough; and a second protruding tube in fluid communication with said second outlet facilitating fluid flow therethrough.

26. The planetary mill as defined in claim 18 wherein said supply contains a slurry comprising the material to be mixed and/or ground mixed with a liquid.

27. A planetary mill for grinding and/or mixing material, comprising:

a support frame;

a first motor mounted to said support frame;

a second motor mounted to said support frame;

a first gyration arm mounted to said support frame;

a first container rotatably mounted at a first end of said first gyration arm such that said first container is rotatable by said second motor about a first axis; and a second container rotatably mounted at a second end of said first gyration arm such that said second container is rotatable by said second motor about a second axis different from said first axis; and a split shaft drive having a first shaft and a second shaft defining a third axis, said first shaft coupled to said second motor to drive said first and second containers and said second shaft coupled to said first motor for rotating said first gyration arm about said third axis, which is different from said first axis and different from said second axis.

28. The planetary mill as defined in claim 27 further comprising:

a second gyration arm mounted to said support frame substantially perpendicular with said first gyration arm, said second gyration arm being rotatable by said first motor about said third axis.

29. The planetary mill as defined in claim 27 further comprising:

a second gyration arm mounted to said support frame such that a first angle formed between said second gyration arm and said first gyration arm is approximately sixty degrees, said second gyration arm being rotatable by said first motor about said third axis; and a third gyration arm mounted to said support frame such that a second angle formed between said third gyration arm and said first gyration arm is approximately sixty degrees and such that a third angle formed between said third gyration arm and said second gyration arm is approximately sixty degrees, said third gyration arm being rotatable by said first motor about said third axis.

30. The planetary mill as defined in claim 27 further comprising:

a second gyration arm mounted to said support frame such that a first angle formed between said second gyration arm and said first gyration arm is approximately forty-five degrees, said second gyration arm being rotatable by said first motor about said third axis;

a third gyration arm mounted to said support frame such that a second angle formed between said third gyration arm and said first gyration arm is approximately ninety degrees and such that a third angle formed between said third gyration arm and said second gyration arm is approximately forty-five degrees, said third gyration arm being rotatable by said first motor about said third axis; and a fourth gyration arm mounted to said support frame such that a fourth angle formed between said fourth gyration arm and said first gyration arm is approximately forty-five degrees and such that a fifth angle formed between said fourth gyration arm and said third gyration arm is approximately forty-five degrees, said fourth gyration arm being rotatable by said first motor about said third axis.

31. A method for grinding and/or mixing a material comprising the steps of:

placing a material to be ground and/or mixed in a first container rotatably mounted about a first axis at a first end of a gyration arm, said first container further containing a grinding and/or mixing substance;

rotating a split shaft having first and second shafts defining a second axis different from said first axis;

rotating said gyration arm about said second shaft; and rotating said container about said first axis via said first shaft with a rotation direction and speed independent of said gyration arm.

32. The method as defined in claim 31 further comprising the steps of:

placing the material to be ground and/or mixed in a second container rotatably mounted about a third axis, different from said first axis and said second axis, at a second end of said gyration arm, said second container further containing the grinding and/or mixing substance; and rotating said second container about said third axis via said first shaft with a rotation direction and speed independent of said gyration arm.

33. The method as defined in claim 32 further comprising the steps of:

mixing the material to be ground and/or mixed with a liquid to create a slurry;

feeding said slurry into said first container and into said second container; and collecting slurry including material that has been ground and/or mixed from said first container and from said second container.

34. The method as defined in claim 33 wherein said steps of feeding and collecting are accomplished continuously.

35. The method as defined in claim 32 wherein said step of rotating of said gyration arm is accomplished at a fixed rotational speed.

36. The method as defined in claim 32 wherein said first container and said second container are both rotatable at variable speeds.

37. The method as defined in claim 31 further comprising the steps of:

mixing the material to be ground and/or mixed with a liquid to create a slurry;

feeding said slurry into said first container; and collecting slurry including material that has been ground and/or mixed from said first container.

38. The method as defined in claim 37 wherein said steps of feeding and collecting are accomplished continuously.

39. The method as defined in claim 31 wherein said step of rotating of said gyration arm is accomplished at a fixed rotational speed.

40. The method as defined in claim 31 wherein said container is rotatable at variable speeds.

* * * * *